US009063494B2

(12) United States Patent
Tokuda

(10) Patent No.: US 9,063,494 B2
(45) Date of Patent: Jun. 23, 2015

(54) FIXING DEVICE PROVIDED WITH A SHEET MATERIAL HAVING PENETRATING HOLES BETWEEN SEPARATION GUIDES AND PRINTING DEVICE

(71) Applicants: CASIO ELECTRONICS MANUFACTURING CO., LTD., Iruma-shi, Saitama (JP); CASIO COMPUTER CO., LTD., Shibuya-ku, Tokyo (JP)

(72) Inventor: Yusuke Tokuda, Hino (JP)

(73) Assignees: CASIO ELECTRONICS MANUFACTURING CO., LTD., Iruma-shi, Saitama (JP); CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 13/951,263

(22) Filed: Jul. 25, 2013

(65) Prior Publication Data

US 2014/0029990 A1 Jan. 30, 2014

(30) Foreign Application Priority Data

Jul. 26, 2012 (JP) ..... 2012-165440

(51) Int. Cl.

*G03G 15/20* (2006.01)
*G03G 15/00* (2006.01)
*G03G 21/20* (2006.01)

(52) U.S. Cl.

CPC ..... *G03G 15/2085* (2013.01); *G03G 15/6573* (2013.01); *G03G 21/203* (2013.01); *G03G 2215/0132* (2013.01); *G03G 15/2028* (2013.01)

(58) Field of Classification Search

CPC ..... G03G 15/2085; G03G 15/2028
USPC ..... 399/92, 323
See application file for complete search history.

(56) References Cited

U.S. PATENT DOCUMENTS

| | | | | |
|---|---|---|---|---|
| 5,671,471 | A * | 9/1997 | Mizuno et al. | 399/297 |
| 6,564,030 | B2 * | 5/2003 | Baughman et al. | 399/323 |
| 6,963,717 | B1 * | 11/2005 | Klimley et al. | 399/323 |
| 7,013,572 | B1 * | 3/2006 | Morganti et al. | 399/323 |
| 7,466,949 | B2 * | 12/2008 | Satoh et al. | 399/323 |
| 7,693,435 | B2 * | 4/2010 | Moriguchi et al. | 399/33 |
| 8,195,073 | B2 * | 6/2012 | Sakai | 399/323 |
| 2007/0140752 | A1 * | 6/2007 | Yamamoto et al. | 399/323 |
| 2013/0251417 | A1 * | 9/2013 | Ishimori | 399/323 |

FOREIGN PATENT DOCUMENTS

JP 2007-140189 A 6/2007

* cited by examiner

*Primary Examiner* — Clayton E. Laballe
*Assistant Examiner* — Leon W Rhodes, Jr.
(74) *Attorney, Agent, or Firm* — Holtz, Holtz, Goodman & Chick PC

(57) ABSTRACT

A penetrating hole is positioned facing a concave area between a separation guide and a separation guide of a sheet supporting the separation guides. When the front edge of a printing medium has passed through and emerged from a fixing clasp, water vapor generated from the printing medium by heating from a heating belt catches airflow flowing along a circulation movement surface of the heating belt and is sucked into a spatial region where a frame of the fixing device body is positioned from the penetrating hole.

12 Claims, 3 Drawing Sheets

FIXING DEVICE PROVIDED WITH A SHEET MATERIAL HAVING PENETRATING HOLES BETWEEN SEPARATION GUIDES AND PRINTING DEVICE

CROSS-REFERENCE TO RELATED APPLICATION

This application claims the benefit of Japanese Patent Application No. 2012-165440, filed on Jul. 26, 2012, the entire disclosure of which is incorporated by reference herein.

FIELD

This application relates generally to a fixing device, and more particularly, to a fixing device for preventing generation of image disorders caused by water droplets from water vapor generated from a printing medium and also preventing generation of separation guide marks on formed images of a printing medium at the time of fixing.

BACKGROUND

In the past, an image-forming device has been known for forming a toner image in an electronic photo format using toner on an image support body, transferring this toner image directly or indirectly to paper and forming an image by fixing this transferred toner image to the paper using a fixing device.

This kind of image fixing device comprises for example multiple internal devices such as a paper supply unit, an image-forming unit, a transfer belt unit, a fixing unit and/or the like. Among these, in the fixing process, being the final process in image formation, various schemes are implemented in the fixing device in order to prevent negative effects from being applied to the formed image.

For example, there are cases in which flaws could occur, such as toner adhered to the fixing separator growing in a ribbon shape in a direction parallel to the direction of surface movement of the fixing belt that is a fixation nip former, becoming a large lump and having a negative effect on image quality.

In order to prevent this kind of flaw, Unexamined Japanese Patent Application Kokai Publication No. 2007-140189 proposes a fixing device provided with a separation claw in which is formed a groove extending in a direction orthogonal to the surface movement direction of the fixing belt and on a fixing belt contact position downstream side facing plane facing the surface of the surface movement direction downstream side of the fixing belt more than the position of contact with the fixing belt.

However, in the fixing process in this fixing device, there is a problem that toner adheres to the fixing belt in the surface movement direction, as well as the problem that when the separation claw is provided in a rib shape in order to minimize contact with the image-forming plane, a linear separation guide mark remains on the formed image plane.

The device disclosed in Unexamined Japanese Patent Application Kokai Publication No. 2007-140189 prevents toner adhered in the surface movement direction of the fixing belt from growing in a belt shape by a groove being formed on the back surface of the separation claw, but is not related to the front surface structure of the separation claw and thus does not give consideration to resolving the problem of separation guide marks remaining on the formed image.

In addition, besides the above-described problems, in the fixing process in this fixing device, there is the problem that water that the printing medium has absorbed at room temperature becomes water vapor and evaporates when heat is added, and this water vapor adheres to the sheet metal with which the ribs and/or the like of the separation guide are assembled and becomes water droplets, and these water droplets adhere to the printing medium and have a negative effect on the quality of the formed image.

In consideration of the foregoing, it is an objective of the present invention to provide a fixing device that prevents the occurrence of separation guide marks on the formed image of the printing medium at the time of fixing and that also prevents the occurrence of image flaws by water droplets caused by water vapor generated from the printing medium.

SUMMARY

With the first aspect of the present invention, a fixing device is provided comprising: a heating belt; a fixing roller bridged by the heating belt; a pressure roller; multiple separation guides for guiding to a discharge section a printing medium that has passed through a fixing clasp abutted by the fixing roller and the pressure roller via the heating belt, and positioned on the discharge path of the printing medium; and a sheet supports the separation guides, anchored to the fixing device body and having penetrating holes between the separation guides. With the second aspect of the present invention, a printing device is provided comprising: a heating belt; a fixing roller bridged by the heating belt; a pressure roller; multiple separation guides for guiding to a discharge section a printing medium abutted by the fixing roller and the pressure roller via the heating belt, and positioned on a discharge path of the printing medium; and a sheet supports the separation guides, and having penetrating holes between the separation guides.

BRIEF DESCRIPTION OF THE DRAWINGS

A more complete understanding of this application can be obtained when the following detailed description is considered in conjunction with the following drawings, in which.

DETAILED DESCRIPTION

Below, a preferred embodiment of the present invention is described in detail with reference to the drawings.

First Preferred Embodiment

Figure 1:
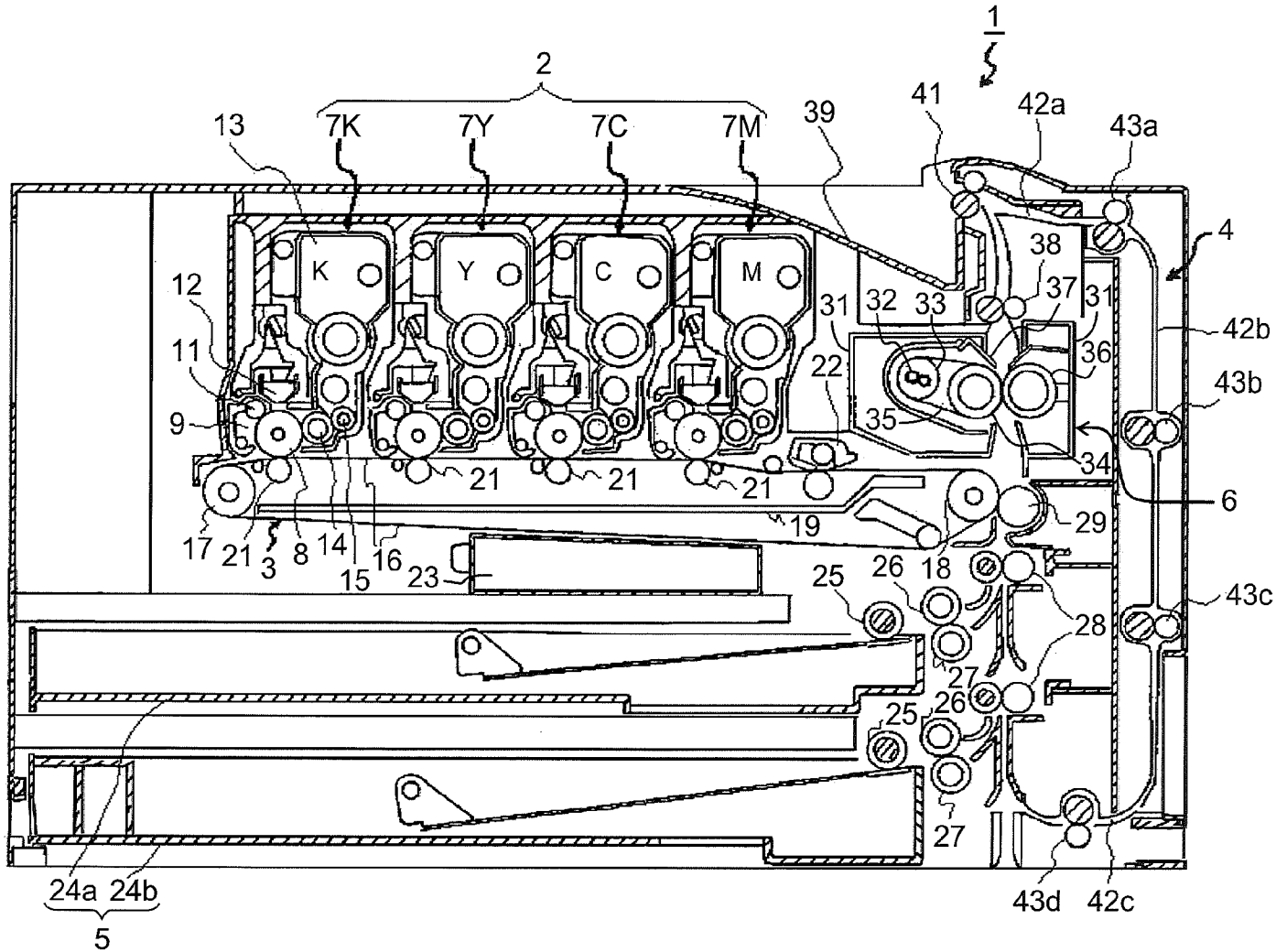
FIG. 1 is a cross-sectional view explaining the internal composition of a full-color image-forming device (printer, device body) provided with a fixing device according to a first preferred embodiment of the present invention.

FIG. 1 is a cross-sectional view explaining the internal composition of a full-color image-forming device (hereafter called a printer or device body) provided with a fixing device according to a first preferred embodiment of the present invention. As shown in the drawing, a printer 1 comprises an image former 2, a transfer belt unit 3, a duplex printing conveyor unit 4, a paper feeder 5 and a fixing device 6.

The image former 2 comprises four image-forming units 7 (7M, 7C, 7Y and 7K) in order from right to left in the drawing, provided in a multi-stage arrangement. The image-forming unit 7K forms monochrome images with black (K) toner used primarily in the dark parts of images and characters, and/or the like.

In addition, of the four image-forming units 7 (7M, 7C, 7Y and 7K), the three image-forming units 7M, 7C and 7Y on the upstream side (the right side in the drawing) form mono-color images with toner colored magenta (M), cyan (C) and yellow (Y), respectively, these being the three primary subtractive colors.

All of the above-described image-forming units 7 (7M, 7C, 7Y and 7K) have the same composition with the exception of the color of toner stored inside the toner container (toner cartridge). Accordingly, the composition thereof is explained below taking as an example the image-forming unit 7K for black (K).

The image-forming units 7 (7M, 7C, 7Y and 7K) comprise a photosensitive drum 8 on the bottom-most part. This photosensitive drum 8 is such that the surface thereof is composed for example of an organic light-conductive material. Contacting the surface of this photosensitive drum 8 or surrounding the proximity thereof, a cleaner 9, a charged roller 11, an optical writing head 12 and a developing roller 14 of a developer 13 are arranged.

Toner in either magenta (M), cyan (C), yellow (Y) or black as indicated by M, C, Y and K in the drawing are stored in the toner container above the developer 13, and the developer 13 is provided in the center with a toner supply mechanism toward the bottom.

In addition, the bottom of the developer 13 is provided with the aforementioned developing roller 14 at the side surface opening, and is provided with a toner supply roller 15 having a toner stirring member on the inside and supplying toner to the developing roller 14, and a doctor blade and/or the like for regulating the toner layer on the developing roller 14 to a constant thickness.

The transfer belt unit 3 is provided with an endless transfer belt 16 substantially in the center of the body and extending in a flat loop substantially from edge to edge of the left and right in the drawing, a drive roller 17 bridged by this transfer belt 16 and causing the transfer belt 16 to circulate in a counterclockwise direction in the drawing, and a following roller 18.

The above-described transfer belt 16 transfers (primary transfers) a toner image directly to the belt surface and conveys that toner image to a transfer position to a printing medium (hereafter, paper) to transfer (secondary transfer) to the paper, and hence the unit as a whole is here called an intermediate transfer belt unit.

This transfer belt unit 13 is provided with a belt position control mechanism 19 in the loop of the above-described transfer belt 16 having a flat loop shape. The belt position control mechanism 19 is provided with a primary transfer roller 21 comprising a conductive foam sponge that presses on the bottom surface of the photosensitive drum 8 via the transfer belt 16.

The belt position control mechanism 19 causes three primary transfer rollers corresponding to the three image-forming units 7M, 7C and 7Y for magenta (M), cyan (C) and yellow (Y) to rotate with the same period about a hook-shaped support shaft.

Furthermore, the belt position control mechanism 19 causes the one primary transfer roller 21 corresponding to the image-forming unit 7K for black (K) to rotate with a different period than the above-described three primary transfer rollers 21 and causes the transfer belt 16 to be separated from the photosensitive drum 8.

In the above-described transfer belt unit 3, a belt cleaner 22 is positioned further to the upstream side of the image-forming unit 7M on the most upstream side in the belt movement direction on the top surface. In addition, a flat, thin waste toner recovery container 23 is removably positioned along the bottom surface of the transfer belt unit 3.

The belt cleaner 22 and the waste toner recovery container 23 are linked by a temporary collector, waste toner conveyance screw and falling tube, although such are not particularly depicted in the drawing.

The paper feeder 5 is provided with two paper feed cassettes 24 (24*a*, 24*b*) positioned in two stages up and down. Near the paper feed openings (to the right in the drawing) of the two paper feed cassettes 24 a paper retrieval roller 25, a feed roller 26, a handling roller 27 and a standby conveyor roller pair 28 are provided, respectively.

A secondary transfer roller 29 pressed against the following roller 18 via the transfer belt 16 is provided in the paper conveyance direction (vertically upward in the drawing) of the standby conveyor roller pair 28. A secondary transferer to paper is formed by the transfer belt 16, the following roller 18 and the secondary transfer roller 29.

On the downstream (upward in the drawing) side of this secondary transferer, the fixing device 6 is provided. The fixing device 6 comprises a belt-type fixing unit. This belt-type fixing unit is provided with a heater, a pressurizer and a guide on the inside of a heat-insulating casing 31.

The heater comprises a heating roller 33 mounted inside a heat source 32, a fixing roller 34 made of foam rubber including foam of silicon sponge and/or the like, for example, and a heating belt 35 bridging the heating roller 33 and the fixing roller 34. In addition, the heater comprises a pressure roller 36 that is a rubber roller and/or the like that presses against the fixing roller 34 via the heating belt 35.

In addition, the guide, as described in detail below, comprises a separation guide 37 positioned abutting or near an area where the heating belt 35 bridges the fixing roller 34, near an area interposed between the fixing roller 34 and the heating roller 36.

A carryout roller pair 38 for carrying out post-fixing paper from the fixing device 6 and a paper discharge roller pair 41 for discharging paper that is conveyed into a discharge paper tray 39 formed on the device top surface are provided further to the downstream side of the fixing device 6.

In the duplex printing conveyor unit 4, the outside surface (the surface on the outside of the right side of the drawing) also serves as an opening and closing member as a right side cover of the printer 1. The duplex printing conveyor unit 4 is provided with a return path branching to the right side direction in the drawing from the conveyance path between the carryout roller pair 38 and the paper discharge roller pair 41.

This return path is provided with a starting return path 42*a*, an intermediate return path 42*b* bending downward, a terminal return path 42*c* bending to the left side that ultimately causes the return paper to be reversed, and four sets of return roller pairs 43*a*, 43*b*, 43*c* and 43*d* positioned midway along these return paths.

The exit of the above-described terminal return path 42*c* is linked to the conveyor route to the standby conveyor roller pair 28 facing the paper feed cassette 24*b* below the paper feeder 5.

This printer 1 is not of the type that transfers a toner image directly to paper from the image-forming unit 7, but is of a type that does secondary transfer of the toner image via the intermediate transfer belt 16 to paper conveyed in the vertical direction to the secondary transferer by the standby conveyor roller pair 28.

Figure 2:
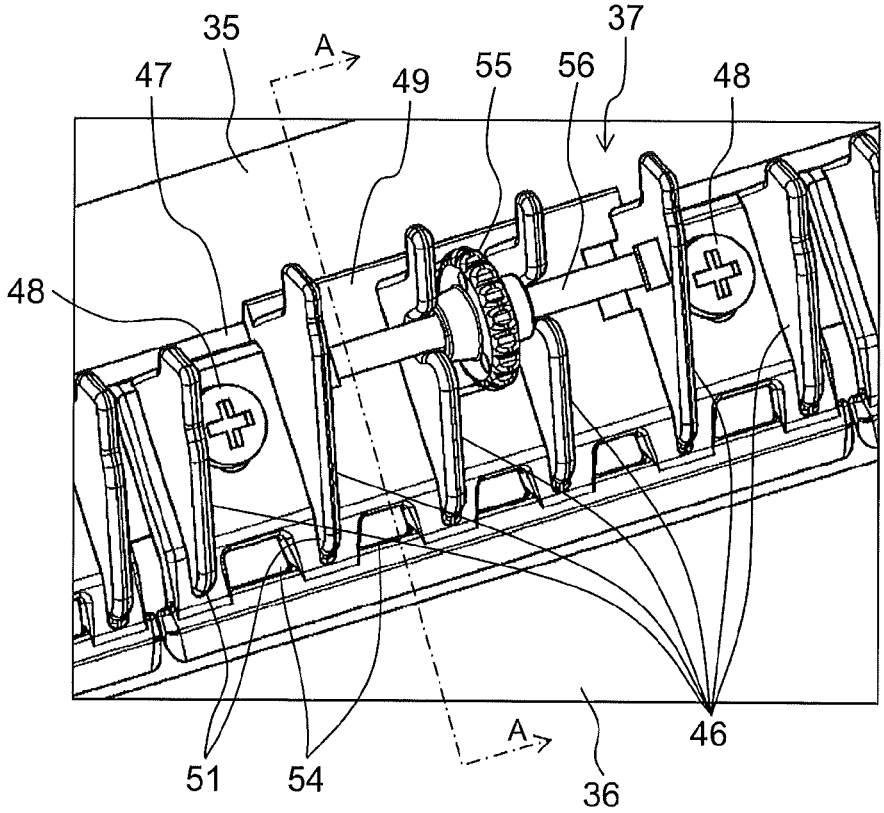
FIG. 2 is an oblique view taking out and showing in detail the composition of one block of the separation guide in a fixing device according to the first preferred embodiment.

FIG. 2 is an oblique view taking out and showing in detail the composition of one block of the separation guide 37 in the above-described fixing device 6. This separation guide 37 has the one block shown in FIG. 2 linked to five blocks in the sideways direction, and is positioned extending in the paper depth direction of FIG. 1 abreast of the fixing roller 34 and the pressure roller 36.

Figure 3:
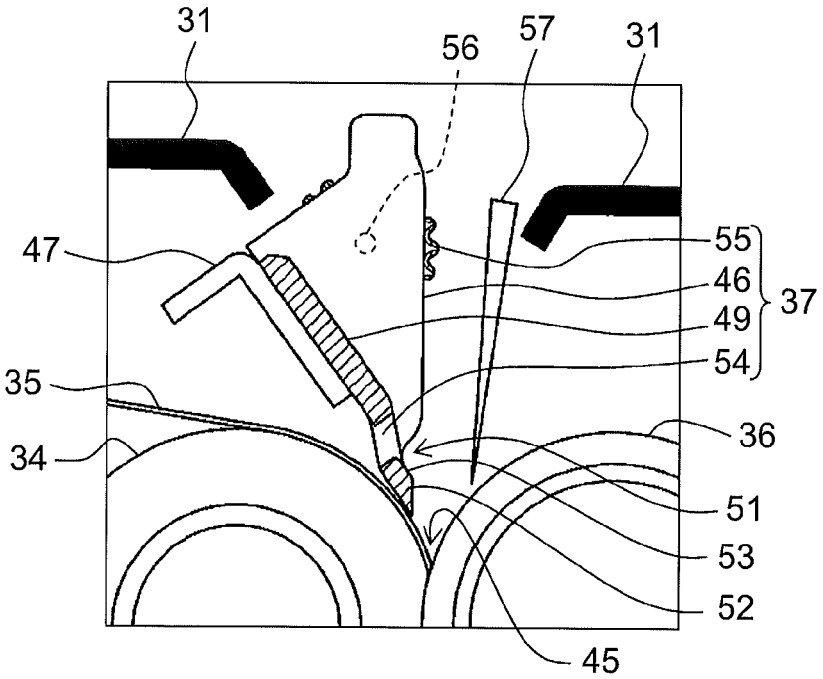
FIG. 3 is a cross-sectional view taken along line A-A in FIG. 2.

FIG. 3 is a cross-sectional view taken along line A-A in FIG. 2. In FIGS. 2 and 3, constituent components that are the same as in FIG. 1 are shown labeled with the same numbers as in FIG. 1.

The separation guide 37 shown in FIGS. 2 and 3 is disposed to guide to the discharge section at which the discharge roller pair 38 (see FIG. 1) is positioned the printing medium that has passed through a fixing clasp 45 against which the fixing roller 34 and the pressure roller 36 press via the heating belt 35.

The separation guide 37 is provided with a separation guide 46 with multiple ribs and/or the like positioned on the fixing roller 34 side and a sheet 49 holding this separation guide and anchored by a bolt 48 to a frame 47 of the fixing device body, with respect to the discharge path of the printing medium from the fixing clasp 45 to the discharge roller pair 38.

The separation guide 46 is made of resin and/or the like, and the frame 47 is made of sheet metal and/or the like. A hole is opened in the frame 47 in order to fasten the bolt 48, but at the time of fixing the hole is obstructed by the bolt 48, so it is impossible for water vapor to escape.

The multiple separation guides 46 held by the above-described sheet 49 each have a concave area 51 formed on the bottom side. In response to this concave area, the bottom of the sheet 49 also has a vertical surface 52 formed coplanar with the front surfaces of the multiple separation guides 46 and a concave area from an inclined surface 53 sloping to the fixing roller 34 side and connecting to this vertical surface 52.

Viewed as a whole, in other words, the bottom of the multiple separation guides 46 forms an upward-sloping surface of the concave area 51 of the separation guide 37 and the bottom of the sheet 49 forms a downward-sloping surface of the concave area 51.

Furthermore, the sheet 49 has formed therein penetrating holes 54 positioned facing the concave area 51 between the separation guide 46 and the separation guide 46. In addition, in the separation guide 37 an idle gear 55 is positioned rotatably supported on a support shaft 56 between the two separation guides in the center of the one block.

Above the fixing clasp 45, an separation guide claw 57 is provided at a position along the pressure roller 36 side of the discharge path of the printing medium, facing the separation guide 37. The printing medium surface guided by the separation guide claw 57 is the surface in which no image is formed or the surface of duplex printing on which an image that has already been fixed is formed, so the separation guide claw 57 has a simple shape.

In addition, as shown in FIG. 3, the fixing roller 34 is deformed at the fixing clasp 45 pressing against the fixing roller 36. This is because the fixing roller 34 contains foam rubber including foam of a silicon sponge and/or the like and is soft compared to the pressure roller 36 containing rubber and/or the like.

Furthermore, the heating belt 35 is interposed between the fixing roller 34 and the pressure roller 36, but is not seen at the fixing clasp 45 on which the fixing roller 34 and the pressure roller 36 press against each other.

This is because in the width of the direction orthogonal to the conveyance direction of the printing medium 58, the width of the fixing roller 34 and the width of the pressure roller 36 are substantially equivalent, but the width of the heating belt 35 is narrower than the width of the fixing roller 34 or the width of the pressure roller 36. In addition, the width in the direction orthogonal to the conveyance direction of the printing medium 58 is narrower than the width of the heating belt 35.

Figure 4A:
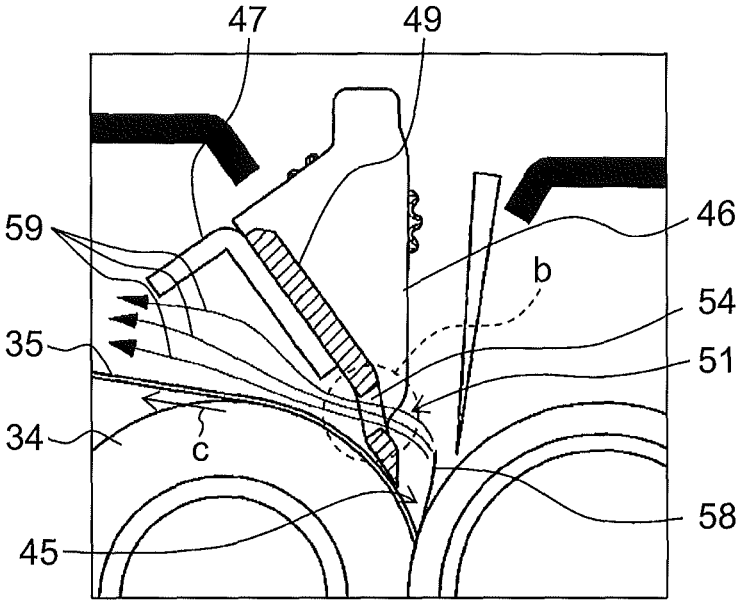
FIG. 4A is a drawing explaining the action state in which a separation guide in a fixing device according to the first preferred embodiment functions during the fixing process.
Figure 4B:
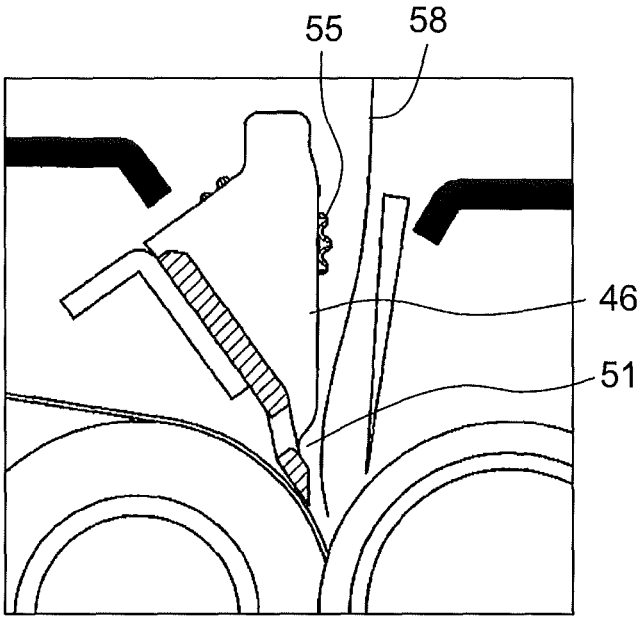
FIG. 4B is a drawing explaining the action state in which a separation guide in a fixing device according to the first preferred embodiment functions during the fixing process.

FIGS. 4A and 4B are drawings explaining the action state in which the above-described separation guide 37 functions during the fixing process. The composition shown in FIGS. 4A and 4B is the same as the composition of FIG. 3, so in FIGS. 4A and 4B, only parts necessary for explanation are shown labeled with the same numbers as the composition of FIG. 3.

FIG. 4A shows the state at the time when the front edge of the printing medium has passed through and emerged from the fixing clasp 45. As shown by the broken line and circle b in FIG. 4A, a penetrating hole 54 is formed lined up with the concave area 51. The circulation movement surface of the heating belt 35 is driven in a counterclockwise direction as indicated by an arrow c along with the fixing roller 34.

Airflow is generated along the circulation movement surface of the heating belt 35. Water vapor is created, by heating by the heating belt 35, from the printing medium 58 immediately after passing through and emerging from the fixing clasp 45, but this water vapor rides the airflow 59 and is sucked into a spatial region in which the frame 47 of the fixing device body is positioned from the penetrating hole 54.

Before the printing medium 58 enters the fixing clasp 45, water vapor is not generated from the printing medium 58. However, when the printing medium 58 enters the fixing clasp 45, the surface temperature of the fixing roller 34 is 150-180 degrees, so through this heat water vapor is generated from the printing medium 58 immediately after passing through the fixing clasp 45.

This water vapor is not a water component from ink but a water component absorbed by the printing medium 58 at room temperature. The water vapor readily adheres to the bottom (near both edges of the penetrating hole 54) of the separation guide 46 particularly close to the fixing clasp 45. In order to prevent water droplets from adhering to the printing medium 58, the penetrating hole is provided and water vapor escapes.

The printer does not have a structure that is perfectly sealed, so the generated water vapor ultimately escapes to the outside of the printer. Even if water vapor is generated inside the printer, there is no particular problem. If through the printer the state is one in which printing is continuously accomplished, the separation guide 46 also becomes warmer, and because the temperature is relatively high, it is difficult for problems caused by this kind of water vapor to occur.

However, when the printer's power source has just barely been turned on and printing started, or when the printer's power source is turned on but no printing is accomplished for some time and then printing is restarted, the temperature of the separation guide 46 is at a temperature near room temperature or a temperature somewhat lower than the boiling point of water, so problems caused by water vapor are less likely to occur.

This spatial region is a region where the heating roller 33 is positioned. The water vapor spreads in the state of water vapor. In addition, even if this forms as water droplets in some area, this is a location unrelated to the discharge path of the printing medium 58, so regardless, the flaw that water droplets adhere to the image-forming surface of the printing medium 58 and damage quality is resolved.

In addition, in the separation guide at the position of the image-forming surface side of the printing medium 58 immediately after passing through the fixing clasp 45, a concave area 51 is formed, so the image-forming surface of the printing medium 58 does not come into contact with the separation guide immediately after fixing and the problem of separation guide marks is resolved.

In addition, as shown in FIG. 4B, in the course of the printing medium 58 being discharged, even if the image-forming surface is close enough to come into contact with multiple separation guides, for each one block of the separation guide 37 an idle gear 55 is positioned at the center thereof so as to be free to rotate, so even if the image-forming surface of the printing medium 58 comes into contact with the blade edge of the idle gear 55, coming into direct contact with the separation guide is rare. Through this, the problem of separation guide marks is resolved.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

What is claimed is:

1. A fixing device comprising:

a heating belt;

a fixing roller bridged by the heating belt;

a pressure roller;

a plurality of separation guides for guiding, to a discharge section, a printing medium abutted by the fixing roller and the pressure roller via the heating belt, the plurality of separation guides being positioned on a discharge path of the printing medium; and a sheet which supports the plurality of separation guides, the sheet having air holes formed therein between adjacent ones of the plurality of separation guides;

wherein a height of each of the plurality of separation guides from the sheet is higher at a downstream end thereof along the discharge path than at an upstream end thereof along the discharge path; and wherein the air holes are formed in an upstream end of the sheet along the discharge path.

2. The fixing device according to claim 1, further comprising a heating roller bridged with the fixing roller by the heating belt, wherein each of the plurality of separation guides supported by the sheet has a concave area formed in the upstream end thereof.

3. The fixing device according to claim 1, further comprising a separation guide claw provided at a position facing the plurality of separation guides in the discharge path of the printing medium.

4. The fixing device according to claim 2, wherein the fixing roller comprises foam rubber and the pressure roller comprises rubber.

5. The fixing device according to claim 2, wherein a width of the heating belt in a width direction which is orthogonal to a conveyance direction of the printing medium is narrower than a width of the fixing roller and narrower than a width of the pressure roller.

6. The fixing device according to claim 1, wherein the air holes comprise penetrating holes which penetrate through the sheet.

7. The fixing device according to claim 1, wherein the sheet is positioned closer to the fixing roller than to the pressure roller.

8. The fixing device according to claim 6, further comprising a separation guide claw which is positioned closer to the pressure roller than to the fixing roller.

9. The fixing device according to claim 1, wherein the sheet is arranged such that the air holes formed therein face the fixing roller via the heating belt.

10. The fixing device according to claim 7, wherein the sheet is arranged such that the air holes formed therein face the fixing roller via the heating belt.

11. A printing device comprising:

a heating belt;

a fixing roller bridged by the heating belt;

a pressure roller;

a plurality of separation guides for guiding, to a discharge section, a printing medium abutted by the fixing roller and the pressure roller via the heating belt, the plurality of separation guides being positioned on a discharge path of the printing medium; and a sheet which supports the plurality of separation guides, the sheet having air holes formed therein between adjacent ones of the plurality of separation guides;

wherein a height of each of the plurality of separation guides from the sheet is higher at a downstream end thereof along the discharge path than at an upstream end thereof along the discharge path; and wherein the air holes are formed in an upstream end of the sheet along the discharge path.

12. The printing device according to claim 11, further comprising:

an endless transfer belt for supporting and conveying a toner image transferred through primary transfer; and a secondary transfer roller positioned facing the transfer belt.

* * * * *